US006311774B1

(12) United States Patent
Brockman et al.

(10) Patent No.: US 6,311,774 B1
(45) Date of Patent: Nov. 6, 2001

(54) METHOD AND APPARATUS FOR SECURING A WELL CASING TO A WELLBORE

(75) Inventors: Mark W. Brockman, Houston; Klaus B. Huber, Sugar Land, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/493,324

(22) Filed: Jan. 28, 2000

Related U.S. Application Data

(60) Provisional application No. 60/117,877, filed on Jan. 29, 1999.

(51) Int. Cl.[7] ..... E21B 33/00

(52) U.S. Cl. ..... 166/285; 166/289; 166/386; 166/74; 166/177.3; 166/177.4; 166/223

(58) Field of Search ..... 166/278, 289, 166/285, 386, 74, 117.7, 119, 126, 185, 177.3, 177.4, 223, 228

(56) References Cited

U.S. PATENT DOCUMENTS

| | | | |
|---|---|---|---|
| 4,787,457 | | 11/1988 | Webster et al. . |
| 4,842,066 | | 6/1989 | Galiakbarov et al. . |
| 4,869,323 | | 9/1989 | Stagg . |
| 5,107,927 | * | 4/1992 | Whiteley et al. . |
| 5,165,476 | * | 11/1992 | Jones . |
| 5,318,119 | * | 6/1994 | Lowry et al. . |
| 5,829,526 | * | 11/1998 | Rogers et al. . |

* cited by examiner

*Primary Examiner*—Roger Schoeppel
(74) *Attorney, Agent, or Firm*—Trop, Pruner & Hu PC

(57) ABSTRACT

A well casing for receiving well fluid from a producing formation includes a first tubular section that has a tortuous outer surface for directing the flow of a bonding agent around the exterior of the first tubular section. The first tubular section has a central passageway. The well casing also has a second tubular section that is coaxial with and is connected to the first tubular section. The second tubular section has at least one opening for directing well fluid into a central passageway of the second tubular section.

18 Claims, 5 Drawing Sheets

METHOD AND APPARATUS FOR SECURING A WELL CASING TO A WELLBORE

This application claims priority under 35 U.S.C. §119 to U.S. Provisional Application Ser. No. 60/117,877, entitled "SECURING A WELL CASING TO A WELLBORE," filed Jan. 29, 1999.

BACKGROUND

The invention relates to securing a well casing to a well bore.

As shown in FIG. 1, a subterranean well might have a lateral wellbore that is lined by a casing 12. Besides supporting the lateral wellbore, the monobore casing 12 serves as a conduit to carry well fluids out of the lateral wellbore. The lateral wellbore extends through several regions called production zones where a producing formation has been pierced by explosive charges to form fractures 14 in the formation. Near the fractures 14, the monobore casing 12 has perforations 16 which allow well fluid from the formation to flow into a central passageway of the casing 12. The casing 12 is typically secured to the well bore by cement.

SUMMARY

In one embodiment, the invention features a well casing for receiving well fluid from a producing formation. The well casing has a first tubular section that has a tortuous outer surface for directing the flow of a bonding agent around the exterior of the first tubular section. The first tubular section has a central passageway. The well casing also has a second tubular section that is coaxial with and is connected to the first tubular section. The second tubular section has at least one opening for directing well fluid into a central passageway of the second tubular section.

In other embodiment, the invention features a well casing for receiving well fluid from a producing formation. The well casing has a tubular section that has a central passageway for receiving well fluid and a port for directing a bonding agent from the central passageway to a region outside of the tubular section. The casing has a wiper that is slidably mounted on an outer surface of the tubular section and is configured to apply pressure to the bonding agent.

In another embodiment, the invention features a method for use in a well. The method includes using a central passageway of a tubing to receive well fluid from a producing formation and using a tortuous outer surface of the tubing for directing the flow of a bonding agent around an exterior region of the tubing.

In yet another embodiment, the invention features a method for use in a well. The method includes using a central passageway of a tubing to receive well fluid from a producing formation and using a wiper on the outer surface of the tubing to direct flow of a bonding agent around an exterior region of the tubing.

DETAILED DESCRIPTION

Figure 1:
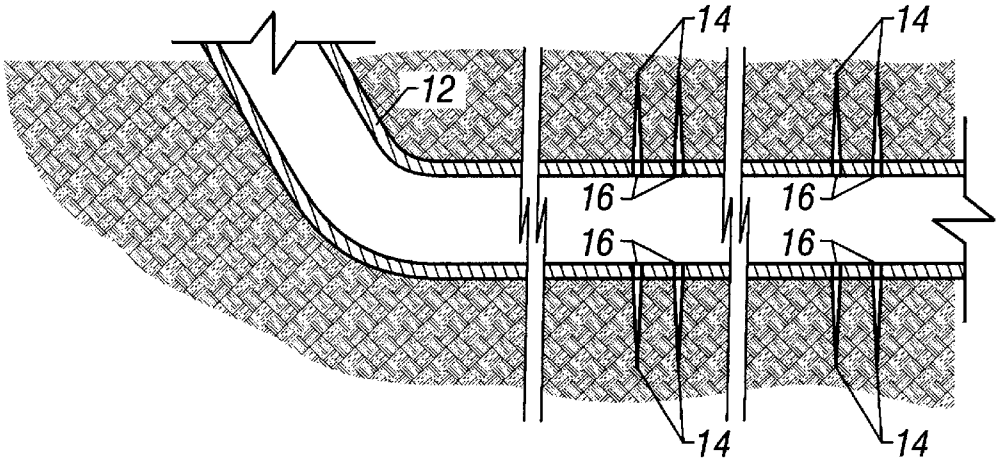
FIG. 1 (Prior Art)
FIG. 1 is a schematic diagram of a lateral well bore of the prior art.
Figure 2:
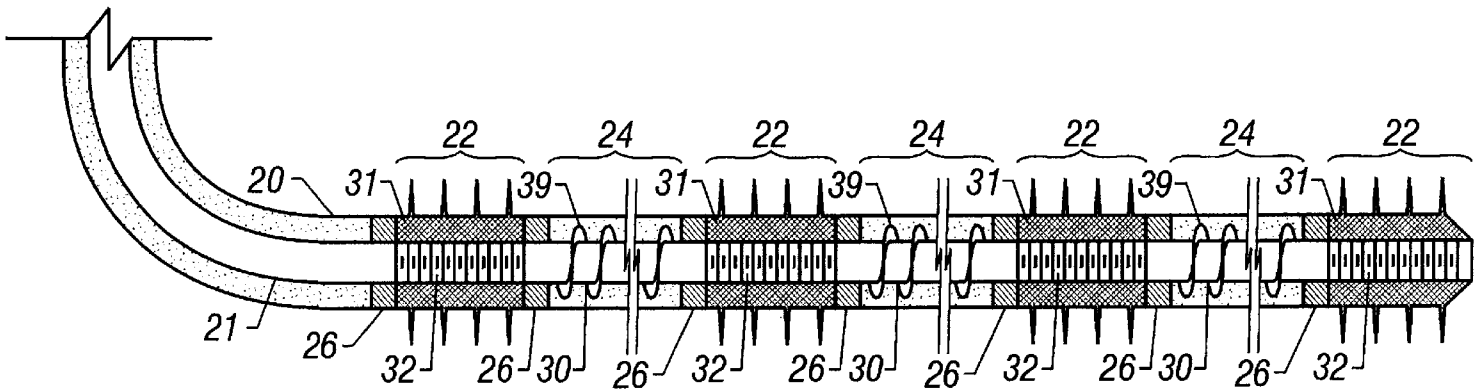
FIG. 2 is a schematic diagram of a well casing according to one embodiment of the invention.

Referring to FIG. 2, cement is selectively placed around a well casing 21 to secure the casing 21 to a lateral well bore 20. To accomplish this, at selected isolation zones 24 of the well bore 20, a wet cement mixture is injected into the annular space between the casing 21 and the well bore 20. Due to gravitational forces, the cement mixture tends to settle before hardening which results in a nonhomogeneous, mixture. However, to combat this, the casing 21 has auger-shaped isolation sections 30 which are placed in the isolation zones 24 to create turbulence in the flow of wet cement around the well casing 21. As a result, water in the wet cement mixture is more evenly distributed, and debri in the well bore 20 is not concentrated in the cement at the bottom of the well bore 20.

The casing 21 is used to support the lateral well bore 20 and carry well fluids away from a producing formation through which the well bore 20 extends. The casing 21 extends through production zones 22 (regions of the well bore capable of furnishing well fluid) and the isolation zones 24 (regions of the well bore 20 in which the casing 21 is cemented to the well bore 20). To capture the well fluid from the production zones 22, the casing 21 has open, screen sections 32 which allow the well fluid to radially enter a central passageway of the casing 20. The region between each screen section 32 and the well bore 20 is packed with a bed 31 of sized gravel, or sand, which filters debri from the well fluid entering the casing 21. The isolation zones 24 are located between the production zones 22, and annular packers 26 separate the two zones 22 and 24.

Among the advantages of the invention may be one or more of the following may be more uniformly distributed; water in wet cement may be more evenly distributed; and debri in a lateral well bore is not concentrated in the cement at the bottom of the well bore.

Figure 3:
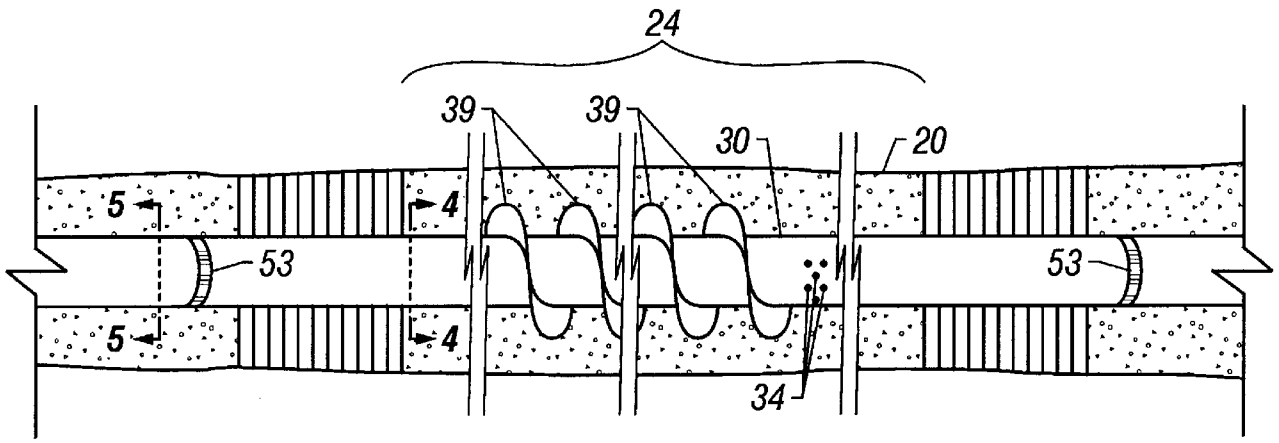
FIG. 3 is a schematic diagram of an insulation zone of the well bore of FIG. 2.

As shown in FIG. 3, each isolation section 30 of the casing 21 has outer fins 39 which extend in a helical pattern around the exterior of the casing 21, with the orientation of the fins 39 determining the direction of flow of wet cement along the section 30. The section 30 has a group of radial openings 34 which divert wet cement from the center passageway of the casing 21 into the annular region between the exterior of the section 30 and the well bore 20. Due to the orientation of the fins 39, the cement flows away from the openings 34 (and away one of the packers 26), through the isolation zone 24 and toward the packer 26 farthest from the openings 34 (i.e., to the end of the isolation zone 24).

Figure 4:
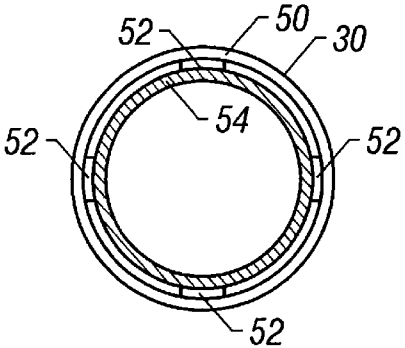
FIG. 4 is a cross-sectional view taken along line 4—4 of FIG. 3.

To facilitate the flow of the cement around the exterior of the section 30, the section 30 may be slowly rotated in a direction to force the wet cement along the isolation zone 24. At the surface of the well, the casing 21 is rotated. However, due to the construction of the casing 21, each screen section 32 (portions of which extend through the packers 26) remain stationary even if the isolation section 30 is being rotated. To accomplish this, the casing 20 has an inner metal tubing 54 (see FIG. 4) which receives the torsional forces (at the surface of the well)to rotate the section 30. Each section 30 has an outer sleeve 50 that circumscribes the tubing 54 and is attatched to the tubing 54 via shear members 52 that radially extend at selected points between the tubing 54 and the outer sleeve 50. The fins 39 are attatched to the exterior of the sleeve 50. Thus, when the tubing 54 rotates, the fins 39 rotate.

Figure 5:
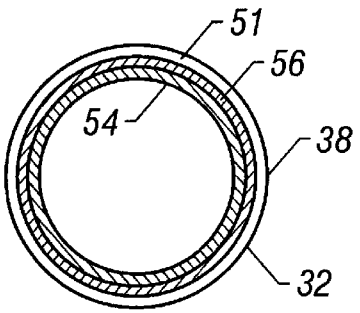
FIG. 5 is a cross-sectional view taken along line 5—5 of FIG. 3.

Referring to FIG. 5, unlike the outer sleeve 50 of the isolation section 32, an outer sleeve 51 of the screen section 30 is not attached to the tubing 54. As a result, torsional forces are not exerted on the packers 26 when the tubing 54 is rotated. A tubular sleeve 56 having a low coefficient of friction covers the exterior of the tubing 54, and the sleeve 51 surrounds the sleeve 56. Annular swivels 53 are located between the rotating sleeves 50 and the stationary outer sleeves 51.

As described below, the wet cement is injected into the isolation zones 24, one at a time. As a result, the cement in some of the zones 24 hardens before the cement in other zones 24. To prevent this hardened cement from preventing rotation of the tubing 54, the spacers 52 (FIG. 4) of each isolation section 30 are designed to shear when the torsional forces exerted by the tubing 54 on the sleeve 50 exceed a predetermined level.

Figure 6:
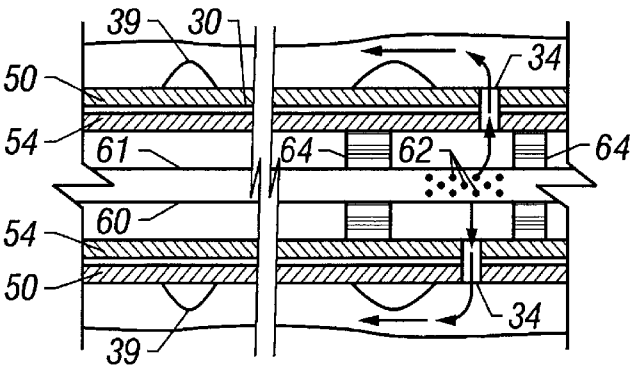
FIG. 6 is a schematic view illustrating the injection of cement within the well bore.

As shown in FIG. 6, the wet cement is furnished to each isolation zone 24 through a cementing tool 60. The tool 60 has a tubing 61 that receives the wet cement from the surface of the well. The tubing 61 has radial openings 62 that allow the cement to pour into the casing 21. Two annular packers 64 located on opposite ends of the openings 62 seal off the annular region between the exterior of the tubing 61 and the interior of the casing 21. The resultant annulus between the packers 64 directs the wet cement through the radial openings 34 in the casing 21.

Figure 7:
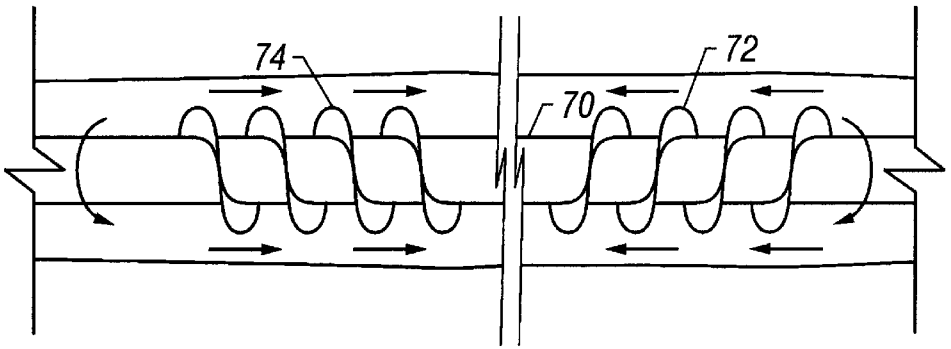
FIG. 7 is a schematic diagram of an alternative embodiment of the isolation section of the invention.

Referring to FIG. 7, in an alternative isolation section 70, the fin 31 may be replaced by opposing helical fins 72 and 74 which are located near opposite ends of the isolation section 70 and compact the wet cement in the region between the fins 72 and 74. Among other advantages, the compaction of the cement removes air pockets to provide a better adhesive bond.

Figure 8:
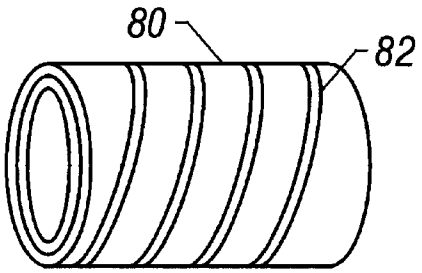

Referring to FIG. 8, instead of having fins extending from the exterior of the casing, an alternative isolation casing section 80 has an exposed channel 82 formed in the outer surface of the casing 21. The channel 82 extends around the casing 21 in a helical pattern and directs the flow of wet cement similar to the fins 31.

Figure 9:
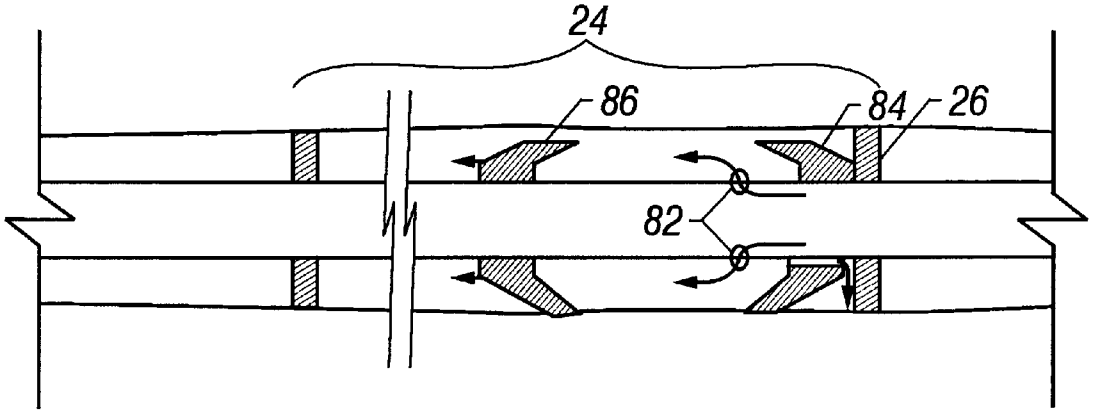
FIGS. 8 and 9 are schematic diagrams of well casings according to other embodiments of the invention.

As shown in FIG. 9, conical wipers 84 and 86 may also be used to distribute the concrete within the isolation zone 24. The wipers 84 and 86 are coaxial with and circumscribe the casing 80. Furthermore, both wipers 84 and 86 are concave with respect to each other and to radial openings 82 in the casing 80. The radial openings 82 are used to inject the wet cement into the isolation zone 24. One wiper 84 is abutted against one of the packers 26 and remains stationary as the cement flows into the isolation zone 24. The other wiper 86 is in frictional contact with the exterior of the casing 80. As the wet cement flows into the annular region surrounding the casing 80, the cement is confined between the two wipers 84 and 86. After the cement fills the void between the two wipers 84 and 86, the pressure exerted by the incoming cement pushes the wiper 86 away from the openings 82. The newly created void is then filled with the incoming wet cement, and the above-described process continues until the wiper 86 rests against the packer 26 and the annulus is filled with cement.

Figure 11:
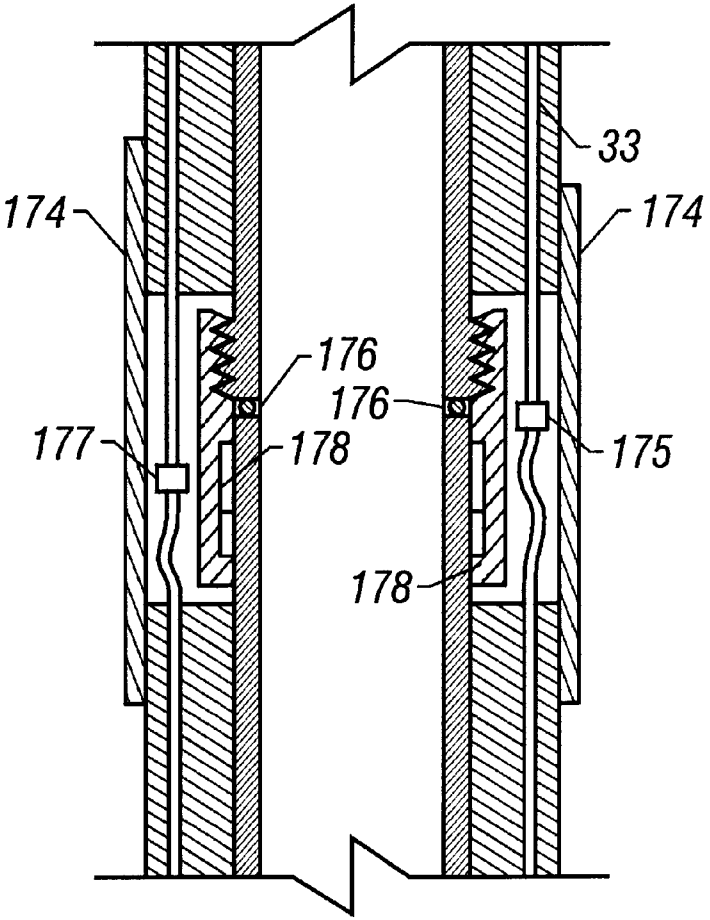
FIGS. 10 and 11 are schematic diagrams of portions of tubing.
Figure 10:
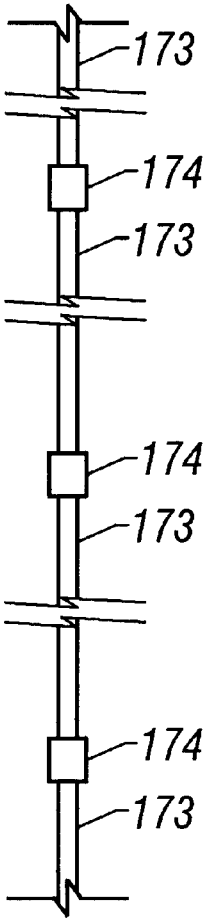

As shown in FIG. 10, in some embodiments, at least a portion of the tubing may be formed out of one or more joined modular sections 173. Adjoining sections 173 may be connected by a variety of different couplers, like the one shown in FIG. 11. At the union of adjoining sections 173, an annular gasket 176 placed at the end of the sections 173 seals tubings 40 of both sections 173 together. To secure the adjoining tubings 40 together, a threaded collar 178 mounted near the end of one tubing 40 is adapted to mate with threads formed near the end of the adjoining tubing 40. The threaded collar 178 is slidably coupled to the tubing 40 and adapted to protect and radially support the gasket 176 once the adjoining tubings 40 are secured together.

After the tubing 40 of adjoining sections 173 are attached to one another, the communication infrastructures of the adjoining sections 173 are coupled together (e.g., via connectors 175 and 177). Once the connections between the tubings 40 and communication infrastructures of adjoining sections 173 are made, a slidably mounted, protective sleeve 174 (located on the outside of the casing 21) is slid over the connections and secured to the encapsulant 33.

The modular sections 173 may be connected in many different arrangements and may be used to perform many different functions. For example, the modular sections 173 may be connected together to form a section of a production string. The sections 173 may be detachably connected together (as described above), or alternatively, the sections 173 may be permanently connected (welded, for example) together. The sections 173 may or may not perform the same functions. For example, some of the sections 173 may be used to monitor production, and some of the sections 173 may be used to control production. The sections 173 may be located in a production zone or at the edge of a production zone, as examples. In some embodiments, a particular section 173 may be left free-standing at the end of the tubing, i.e., one end of the section 173 may be coupled to the remaining part of the tubing, and the other end of the section 173 may form the end of the tubing. As another example, the section(s) 173 may be used for purposes of completing a well. Other arrangements and other ways of using the sections 173 are possible.

While the invention has been disclosed with respect to a limited number of embodiments, those skilled in the art, having the benefit of this disclosure will appreciate numerous modifications and variations therefrom. It is intended that the appended claims cover all such modifications and variations as fall within the true spirit and scope of the invention.

What is claimed is:

1. A well casing for receiving well fluid from a producing formation, the well casing comprising:

a first tubular section having a tortuous outer surface for directing the flow of a bonding agent around the exterior of the first tubular section, the first tubular section having a central passageway; and a second tubular casing section coaxial with and connected to the first tubular casing section, the second tubular casing section having at least one opening for directing well fluid into a central passageway of the second tubular casing section.

2. The well casing of claim 1 wherein the central passageway of the first tubular casing section is capable of receiving the bonding agent, and wherein the first tubular casing section has an opening for directing the bonding agent from the central passageway to the outer surface.

3. The well casing of claim 1 wherein the second tubular casing section comprises a screen circumscribing the central passageway of the second tubular casing section.

4. The well casing of claim 1 further comprising:

an inner tubing coaxial with and extending through the first and second tubular casing sections.

5. The well casing of claim 1 wherein the outer surface comprises a helical fin.

6. The well casing of claim 1 wherein the outer surface comprises two helical fins configured to compact the bonding agent between the two fins.

7. The well casing of claim 1 wherein the outer surface comprises a helical groove.

8. A well casing for receiving well fluid from a producing formation, the well casing comprising:

a tubular section having a central passageway for receiving well fluid and a port for directing a bonding agent from the central passageway to a region outside of the tubular section; and a wiper slidably mounted on an outer surface of the tubular section and configured to apply pressure to the bonding agent.

9. The well casing of claim 8 further comprising:

another wiper secured to the outer surface of the tubular section, the another wiper configured to confine the bonding agent to a predetermined region.

10. The well casing of claim 8 wherein the wiper is further configured to slide along the tubular section in response to pressure exerted by the bonding agent.

11. The well casing of claim 8 wherein the wiper has a conical shape.

12. A method for use in a well, comprising:

using a central passageway of a tubing to receive well fluid from a producing formation to produce the well fluid from the formation; and using a tortuous outer surface of the tubing for directing the flow of a bonding agent around an exterior region of the tubing.

13. The method of claim 12 further comprising:

using an opening of the tubing to direct the bonding agent from the central passageway to the outer surface.

14. The method of claim 12 further comprising:

using a screen in the tubing to receive the well fluid.

15. A method for use in a well, comprising:

using a central passageway of a tubing to receive well fluid from a producing formation; and using a wiper on the outer surface of the tubing to direct flow of a bonding agent around an exterior region of the tubing.

16. The method of claim 15, further comprising:

using another wiper secured to the outer surface of the tubing to apply pressure to the bonding agent.

17. The method of claim 15, further comprising:

sliding the wiper along the tubular section in response to pressure exerted by the bonding agent.

18. The method of claim 15, further comprising:

forming a conical shape with the wiper.

* * * * *